US006878894B2

(12) United States Patent
Schwarz

(10) Patent No.: US 6,878,894 B2
(45) Date of Patent: Apr. 12, 2005

(54) PUSHBUTTON SWITCH

(75) Inventor: Klaus Schwarz, Radolfzell (DE)

(73) Assignee: TRW Automobile Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/817,505

(22) Filed: Apr. 2, 2004

(65) Prior Publication Data

US 2004/0238339 A1 Dec. 2, 2004

(30) Foreign Application Priority Data

Apr. 4, 2003 (DE) ..... 203 05 528 U

(51) Int. Cl.[7] ..... H01H 13/02

(52) U.S. Cl. ..... 200/520; 200/529; 200/533; 200/341

(58) Field of Search ..... 200/405, 416, 200/417, 419–425, 428, 431, 437–439, 453, 459, 533, 520, 573, 574, 529, 341

(56) References Cited

U.S. PATENT DOCUMENTS 4,504,712 A * 3/1985 Donnelly et al. ..... 200/529
4,636,597 A * 1/1987 Menche ..... 200/438
4,654,487 A * 3/1987 Sawada ..... 200/1 V
4,916,269 A * 4/1990 Spazierer et al. ..... 200/408
4,942,276 A * 7/1990 Kato ..... 200/517
4,990,731 A * 2/1991 Wu et al. ..... 200/521
6,396,014 B1 * 5/2002 Minodier et al. ..... 200/332.1
6,710,277 B1 * 3/2004 Wong ..... 200/520

FOREIGN PATENT DOCUMENTS

| | | |
|---|---|---|
| DE | 3034540 | 5/1982 |
| DE | 3336877 | 5/1985 |
| DE | 3402081 | 7/1985 |
| EP | 0572801 | 12/1993 |
| GB | 1488761 | 10/1977 |
| GB | 2110472 | 6/1983 |

* cited by examiner

*Primary Examiner*—Michael A. Friedhofer
(74) *Attorney, Agent, or Firm*—Tarolli, Sundheim, Covell & Tummino L.L.P.

(57) ABSTRACT

A pushbutton switch having a housing (10), a push button (12) mounted in said housing for axial movement between a normal position and a depressed position, the push button being spring-loaded into the normal position and carrying an elastically mounted cam element (24), at least one micro-switch (14) arranged in the housing, and a switch actuating rocker mounted within the housing for pivotal movement, the switch actuating rocker having an actuating arm (20) for actuating the micro-switch and a transmission arm (18) engaged by the cam element to hold the actuating rocker in the normal position when the push button is in the normal position, move the actuating arm away from the micro-switch when the push button is initially depressed, move the actuating arm to a position actuating the micro-switch on movement of the push button to its depressed position, and force the actuating rocker to its normal position on return of the push button from the depressed position to the normal position.

10 Claims, 2 Drawing Sheets

PUSHBUTTON SWITCH

Figure 1:
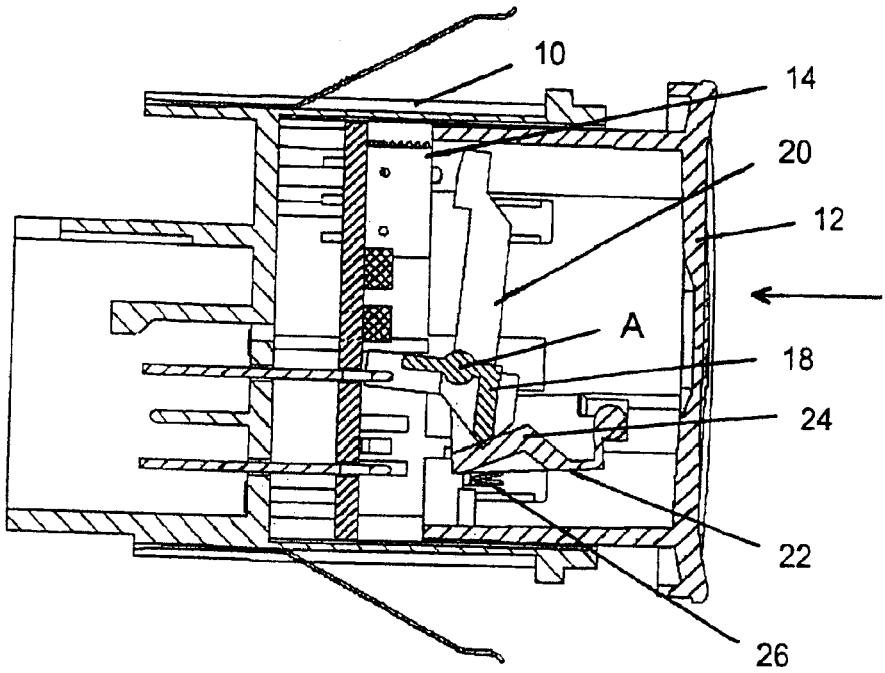

The invention relates to a pushbutton switch for use in motor vehicles, especially a pushbutton switch for actuating an electromotor-powered parking brake.

With pushbutton switches of a conventional design, the electromechanical switching mechanism is actuated directly by an actuation member mounted on the button. Such a pushbutton switch can be damaged if improper force is exerted on the button.

Moreover, with pushbutton switches for certain applications, there is a requirement for two redundant circuits that are independent of each other, and that are actuated simultaneously and within a very short period of time. An example is the above-mentioned pushbutton switch for actuating an electromotor-powered parking brake. Owing to the unavoidable tolerances, the requirement for a simultaneous and rapid actuation of both circuits can only be met with great effort.

The invention provides a pushbutton switch that is not sensitive to excessive actuation forces and that facilitates the simultaneous actuation of plural circuits. The pushbutton switch according to the invention has a housing and a push button that is mounted in the housing for axial movement between a normal position and a depressed position and that is spring-loaded into the normal position. The push button carries an elastically mounted cam element. At least one micro-switch is arranged in the housing and a switch actuating rocker is mounted within the housing for pivotal movement. The switch actuating rocker has an actuating arm for actuating the micro-switch and a transmission arm engaged by the cam element to hold the actuating rocker in the normal position when the push button is in the normal position, to move the actuating arm away from the micro-switch when the push button is initially depressed, to move the actuating arm to a position actuating the micro-switch on movement of the push button to its depressed position and to force the actuating rocker to its normal position on return of the push button from the depressed position to the normal position. When the push button is depressed, the cam element executes an actuating movement since it is coupled to the push button, and this movement acts on the switch actuating rocker. During the actuating movement, the cam element elastically deflects in a direction away from the transmission arm of the rocker so that only small forces are transmitted to the rocker, as a result of which the micro-switch or micro-switches is or are reliably protected against damage. Since a switch actuating rocker with two defined positions is used, its actuating arm can actuate several micro-switches simultaneously and within a very short period of time of less than 20 ms.

In a preferred embodiment the micro-switch is forced by the actuating arm to remain actuated during a first phase of a return movement of the push button from its depressed position to the normal position.

In a switching cycle, the switch actuating rocker is held by the cam element in a controlled manner in one of two positions, except for the very short period of time in which one edge slides on the free end of the transmission arm of the rocker over the apex of the actuating cam element. At this moment, the rocker flips over quickly from its resting position into its actuating position. This advantageous switching behavior can be achieved very simply in that the switching cam element is arranged on a cam lever that is mounted pivotally on the push button and that has a generally parallel orientation with respect to an actuating stroke of the push button between the normal position and the depressed position. A pressure spring is inserted between a free end of the cam lever and a supporting face formed on the push button. The lever has two ramp surfaces that converge in an apex, thus forming the cam element, and the orientation of the transmission arm of the rocker is generally perpendicular to the actuating stroke of the push button.

Figure 2:
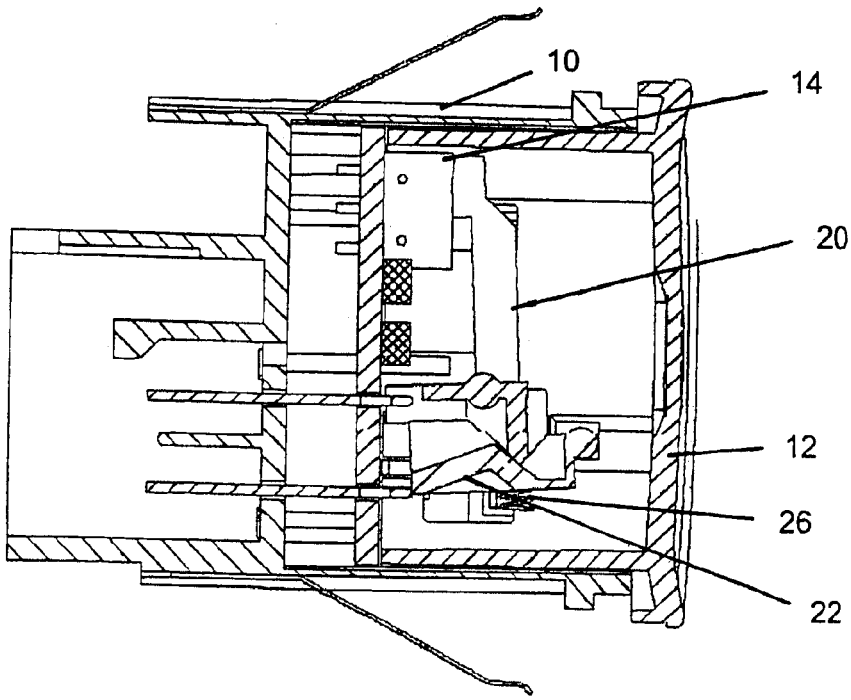
Figure 3:
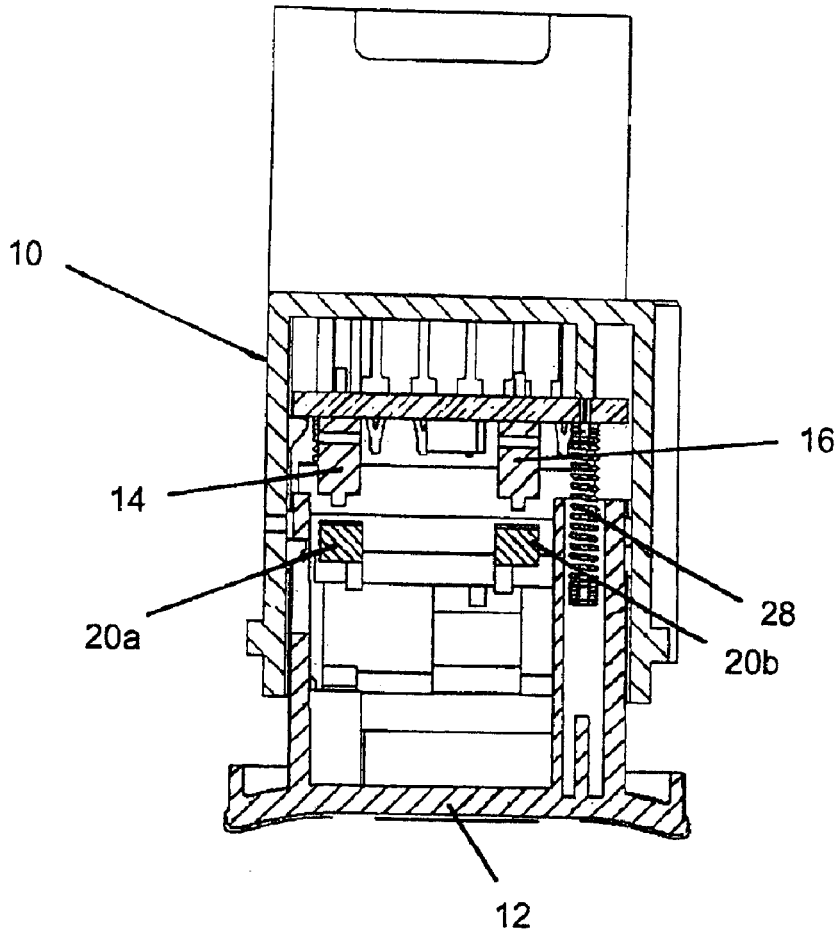

Additional features and advantages of the invention ensue from the following description with reference being made to the accompanying drawings. The drawings show the following:

FIG. 1 a sectional view of a pushbutton switch in the resting position;

FIG. 2 a sectional view of the pushbutton switch in the actuated position; and FIG. 3 another sectional view of the pushbutton switch in a plane perpendicular to the section planes of FIGS. 1 and 2.

The pushbutton switch has a housing 10 made of plastic and a push button 12 that is mounted in the housing 10 for axial movement between a normal position shown in FIG. 1 and a depressed position shown in FIG. 2. On the bottom of the housing 10, there are two micro-switches 14, 16 arranged in parallel next to each other. Above the micro-switches 14, 16, a two-armed switch actuating rocker with a transmission arm 18 and an actuating arm 20 is mounted so as to pivot around an axis A in housing 10. Axis A is perpendicular to the actuation direction of button 12, indicated by an arrow in FIG. 1. As can be seen in FIG. 3, actuating arm 20 is forked and has two parallel legs 20*a*, 20*b*. At its end facing away from button 12, housing 10 is configured as a jack with projecting contact pins.

A one-armed cam lever 22 is mounted pivotally on the inside of button 12. This lever 22 extends generally in the actuation direction of button 12 and has two ramp surfaces that converge in an apex, thus forming a cam element 24. At its free end, transmission arm 18 has an edge that can slide on the ramp surfaces on both sides of the actuating cam element 24. Cam lever 22 is spring-loaded by means of a compression spring 26 against this edge at the end of transmission arm 18. Transmission arm 18 and actuating arm 20 generally extend perpendicular to the actuation direction of push button 12. On each free end of the legs 20*a*, 20*b* of actuating arm 20, there is an actuation button that cooperates with the tappet of the corresponding micro-switch 14 or 16 located underneath.

The button 12 is spring-loaded in its normal position as shown in FIG. 1 by means of a return spring 28 mounted between button 12 and the bottom of housing 10. In this normal position, the ramp surface at the end of cam lever 22 is held in contact with the edge of transmission arm 18 by compression spring 26. In this manner, at the same time, the switch actuating rocker is held in a normal position in which the actuating arm 20 is far away from micro-switches 14, 16. When button 12 is depressed, lever 22 has to give way to transmission arm 18 in that it is pivoted opposite to the force of compression spring 26. When the apex of the actuating cam element 24 reaches the edge on the free end of the transmission arm 18 and is moved beyond it, cam element 24 suddenly engages behind the edge of transmission arm 18. At the same time, the edge of transmission arm 18 now slides on the other ramp surface of cam element 24, and cam lever 22 is pivoted back by compression spring 26, as a result of which transmission arm 18 is pivoted into the position shown in FIG. 2. In this switching position of the rocker, the actuation heads on legs 20*a*, 20*b* of actuating arm 20 press against the tappets of micro-switches 14, 16 and actuate them. The switching procedure thus effectuated takes place in a very short period of time, similar to a snap effect or an effect beyond the dead center position, while the edge of transmission arm 18 slides over the apex of cam element 24. As long as button 12 remains depressed, both micro-switches 14, 16 are actuated. When the button 12 is released, return spring 28 moves it back into the normal position as shown in FIG. 1. In this process, lever 22 once again gives way to transmission arm 18, for which purpose compression spring 26 has to be dimensioned relative to the force of return spring 28. As soon as the apex of cam element 24 has been moved past the edge of transmission arm 18, the switch actuating rocker flips back into the resting position shown in FIG. 1 in which it is then held securely since the end of transmission arm 18 lies on the ramp surface at the end of cam lever 22.

It is evident that the actuation forces exerted on button 12 can never act directly on micro-switches 14, 16, and consequently they are protected from improper use of force. Moreover, it is evident that the switching procedure takes place within a very short period of time, as soon as the apex of cam element 24 slides past the edge of transmission arm 18, thereby creating a clearly perceptible pressure point on button 12. Due to the fast switching procedure and the parallel arrangement of micro-switches 14, 16 as well as of the two legs 20*a*, 20*b* of actuating arm 20, it is ensured that the switching procedures of both micro-switches are simultaneous.

In the preferred embodiment, the visible surface of button 12 is provided with a colored illuminated symbol. When the pushbutton switch is intended for actuating an electromotor-powered parking brake of a vehicle, as provided in the preferred embodiment, then the actuation state of the parking brake is indicated by an appropriate illuminated symbol in button 12. Furthermore, orientation lighting is provided that becomes dimmed as a function of the dimmer setting when the headlights are turned on.

What is claimed is:

1. A pushbutton switch having a housing (10), a push button (12) mounted in said housing (10) for axial movement between a normal position and a depressed position, said push button (12) being spring-loaded into said normal position and carrying an elastically mounted cam element (24), at least one micro-switch (14) arranged in said housing (10), and a switch actuating rocker mounted within said housing (10) for pivotal movement, said switch actuating rocker having an actuating arm (20) for actuating said micro-switch (14) and a transmission arm (18) engaged by said cam element (24) to hold said actuating rocker in said normal position when said push button (12) is in said normal position, move said actuating arm (20) away from said micro-switch (14) when said push button (12) is initially depressed, move said actuating arm (20) to a position actuating said micro-switch (14) on movement of said push button (12) to its depressed position, and force said actuating rocker to its normal position on return of said push button (12) from the depressed position to the normal position.

2. The pushbutton switch according to claim 1, where said micro-switch (14) is forced by said actuating arm (20) to remain actuated during a first phase of a return movement of said push button (12) from its depressed position to the normal position.

3. The pushbutton switch according to claim 1, and comprising a pair of micro-switches (14, 16) arranged within said housing (10) and actuated simultaneously by said actuating rocker.

4. The pushbutton switch according to claim 3, wherein said micro-switches (14, 16) are arranged in parallel next to each other and the rocker has a separate actuating arm (20*a*, 20*b*) for each micro-switch.

5. The pushbutton switch according to claim 1, wherein the cam element (24) is configured on a cam lever (22) that is mounted pivotally on said push button (12) and that has a generally parallel orientation with respect to an actuating stroke of push button (12) between said normal position and said position.

6. The pushbutton switch according to claim 5, wherein said cam lever (22) has two ramp surfaces that converge in an apex, thus forming said cam element (24).

7. The pushbutton switch according to claim 5, wherein a pressure spring (26) is inserted between a free end of said cam lever (22) and a supporting face formed on said push button (12).

8. The pushbutton switch according to claim 1, wherein said actuating rocker has an orientation generally perpendicular to an actuating stroke of said push button (12) between said normal position and said depressed position.

9. The pushbutton switch according to claim 1, characterized by its use in a motor vehicle.

10. The pushbutton switch according to claim 9, characterized by its use for actuating an electromotor-powered parking brake.

* * * * *

UNITED STATES PATENT AND TRADEMARK OFFICE

CERTIFICATE OF CORRECTION

PATENT NO. : 6,878,894 B2
DATED : April 12, 2005
INVENTOR(S) : Klaus Schwarz

It is certified that error appears in the above-identified patent and that said Letters Patent is hereby corrected as shown below:

Title page,
Item [73], Assignee, "TRW Automobile Electronics & Components GmbH & Co. KG," should be -- TRW Automotive Electronics & Components GmbH & Co. KG --.

Signed and Sealed this

Thirtieth Day of August, 2005

JON W. DUDAS
*Director of the United States Patent and Trademark Office*